US012465162B2

(12) United States Patent
Niemi

(10) Patent No.: US 12,465,162 B2
(45) Date of Patent: Nov. 11, 2025

(54) SERVERS TRAY DRINK HOLDER ASSEMBLY

(71) Applicant: Alyceson Niemi, Little Rock, AR (US)

(72) Inventor: Alyceson Niemi, Little Rock, AR (US)

( * ) Notice: Subject to any disclaimer, the term of this patent is extended or adjusted under 35 U.S.C. 154(b) by 34 days.

(21) Appl. No.: 18/391,136

(22) Filed: Dec. 20, 2023

(65) Prior Publication Data

US 2025/0204709 A1 Jun. 26, 2025

(51) Int. Cl.
*A47G 23/06* (2006.01)

(52) U.S. Cl.
CPC ..... *A47G 23/0641* (2013.01); *A47G 23/0633* (2013.01)

(58) Field of Classification Search
CPC ..... B65D 1/34; A47B 13/16; A47G 23/0641; A47G 23/0208; A47G 23/0625; A47G 23/065; A47G 23/02; A47G 23/0616
USPC ..... 294/159, 172; 206/563, 562, 139; 211/74, 71.01
See application file for complete search history.

(56) References Cited

U.S. PATENT DOCUMENTS 2,048,695 A * 7/1936 Hasenour ..... A47G 23/06 211/74
2,695,712 A * 11/1954 Kolander ..... B60N 3/007 211/74
2,895,609 A * 7/1959 Rajotte ..... A47G 23/0633 211/74
4,947,991 A * 8/1990 Snell ..... A47B 13/16 206/427
D571,623 S 6/2008 Loving
7,395,939 B2 * 7/2008 Morris ..... A47K 1/09 211/65
8,272,512 B2 9/2012 Joseph
9,089,235 B2 7/2015 Thornton
D737,104 S 8/2015 Sobotka
9,901,218 B2 2/2018 Fill
2012/0031806 A1 2/2012 Riley
2012/0097627 A1 4/2012 Anderson
2015/0230643 A1 8/2015 Kamei
2022/0110469 A1 4/2022 Barksdale

FOREIGN PATENT DOCUMENTS

GB 2365754 2/2002

* cited by examiner

*Primary Examiner* — King M Chu

(57) ABSTRACT

A server's tray drink holder assembly includes a server's tray which has a continuously arcuate outer perimeter such that the server's tray has a circular shape. In this way the server's tray can be carried by a server while the server is transporting food or beverages to patrons of a restaurant. A carrying plate is removably positionable on top of the server's tray and a plurality of cups is attached to the carrying plate. Each of the plurality of cups can insertably receive a beverage container thereby inhibiting the beverage container from tipping when the server is carrying the server's tray. A plurality of fasteners is each attachable to the carrying plate and the server's tray when the carrying plate is positioned on the server's tray for retaining the carrying plate on the server's tray.

5 Claims, 6 Drawing Sheets

SERVERS TRAY DRINK HOLDER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to drink holder devices and more particularly pertains to a new drink holder device for securing beverage containers on a server's tray to inhibit the beverage containers from tipping. The device includes a server's tray and a carrying plate that can be positioned on the server's tray when a server is carrying beverage containers. The device includes a plurality of cups attached to the carrying plate which can each receive a beverage container thereby inhibiting the beverage container from tipping. The device includes a plurality of fasteners that are attachable to the carrying plate and the server's tray for securing the carrying plate to the server's tray.

(2) Description of Related Art Including Information Disclosed Under 37 CFR 1.97 and 1.98

The prior art relates to drink holder devices including a variety of beverage holder devices that each at least includes a plate which has circular cutouts for holding a beverage container in place while the plate is being carried and a beverage holder device that includes a plate which has a semi-circular shape and which has semi-circular cups for securing beverage containers and a beverage holder pan which has cups for securing beverage containers. In no instance does the prior art disclose a beverage holder device that includes a server's tray and a carrying plate that is positionable on the server's tray and a plurality of cups attached to the carrying plate for securing beverage containers and a plurality of fasteners which secure the carrying plate to the server's tray.

BRIEF SUMMARY OF THE INVENTION

An embodiment of the disclosure meets the needs presented above by generally comprising a server's tray which has a continuously arcuate outer perimeter such that the server's tray has a circular shape. In this way the server's tray can be carried by a server while the server is transporting food or beverages to patrons of a restaurant.

A carrying plate is removably positionable on top of the server's tray and a plurality of cups is attached to the carrying plate. Each of the plurality of cups can insertably receive a beverage container thereby inhibiting the beverage container from tipping when the server is carrying the server's tray. A plurality of fasteners is each attachable to the carrying plate and the server's tray when the carrying plate is positioned on the server's tray for retaining the carrying plate on the server's tray.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
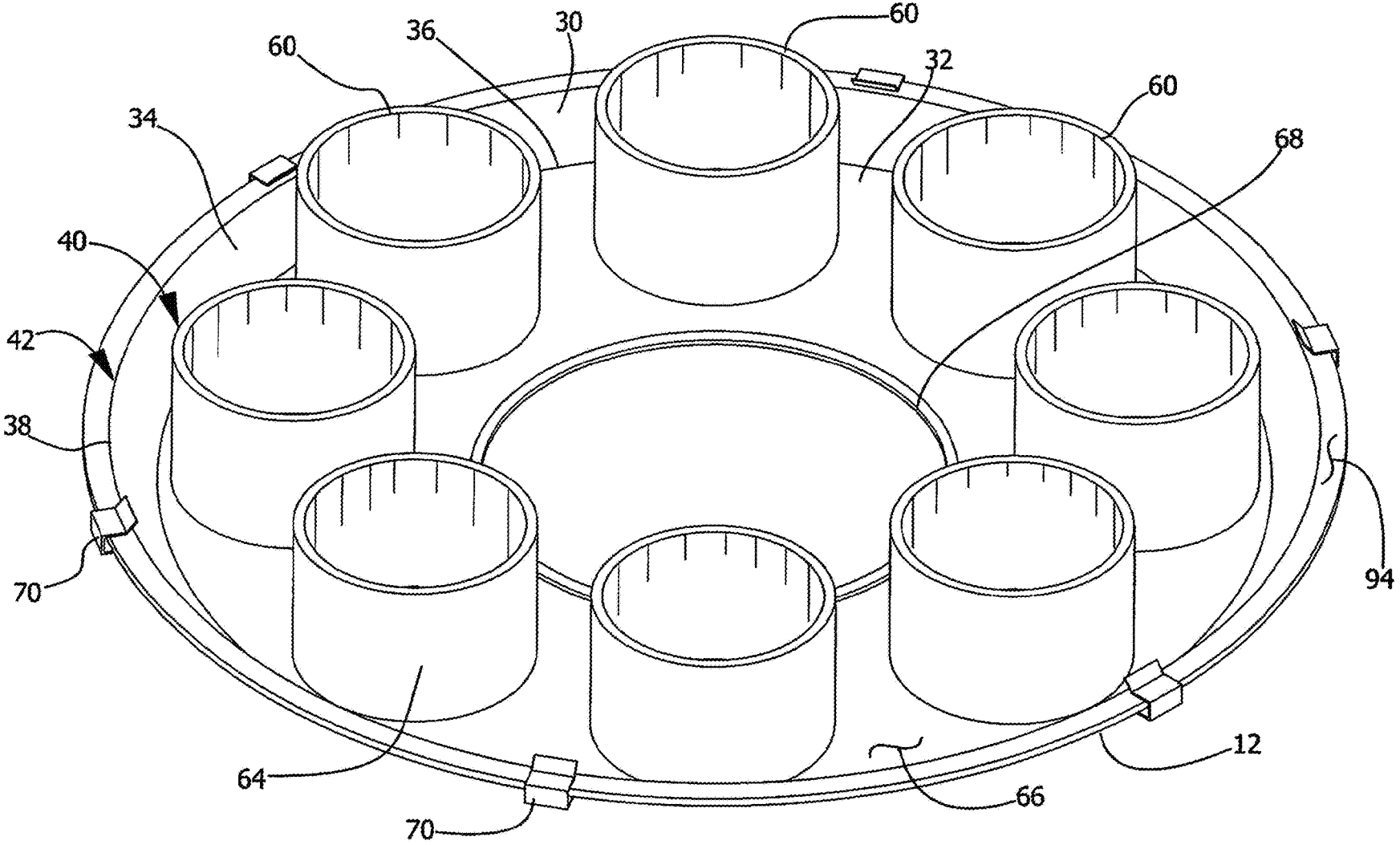
FIG. 1 is a top perspective view of an embodiment of the disclosure.
Figure 2:
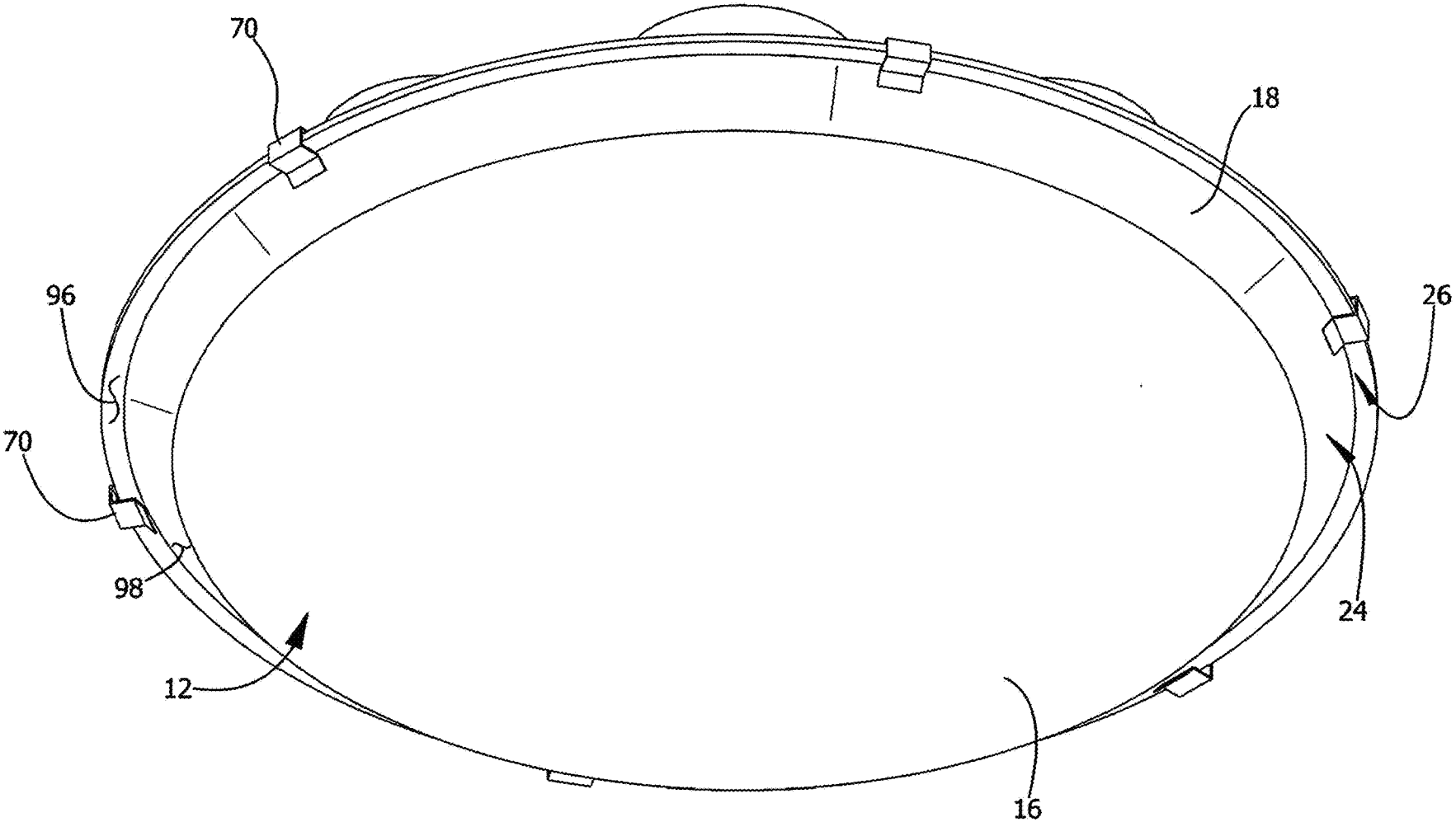
FIG. 2 is a bottom perspective view of an embodiment of the disclosure.
Figure 3:
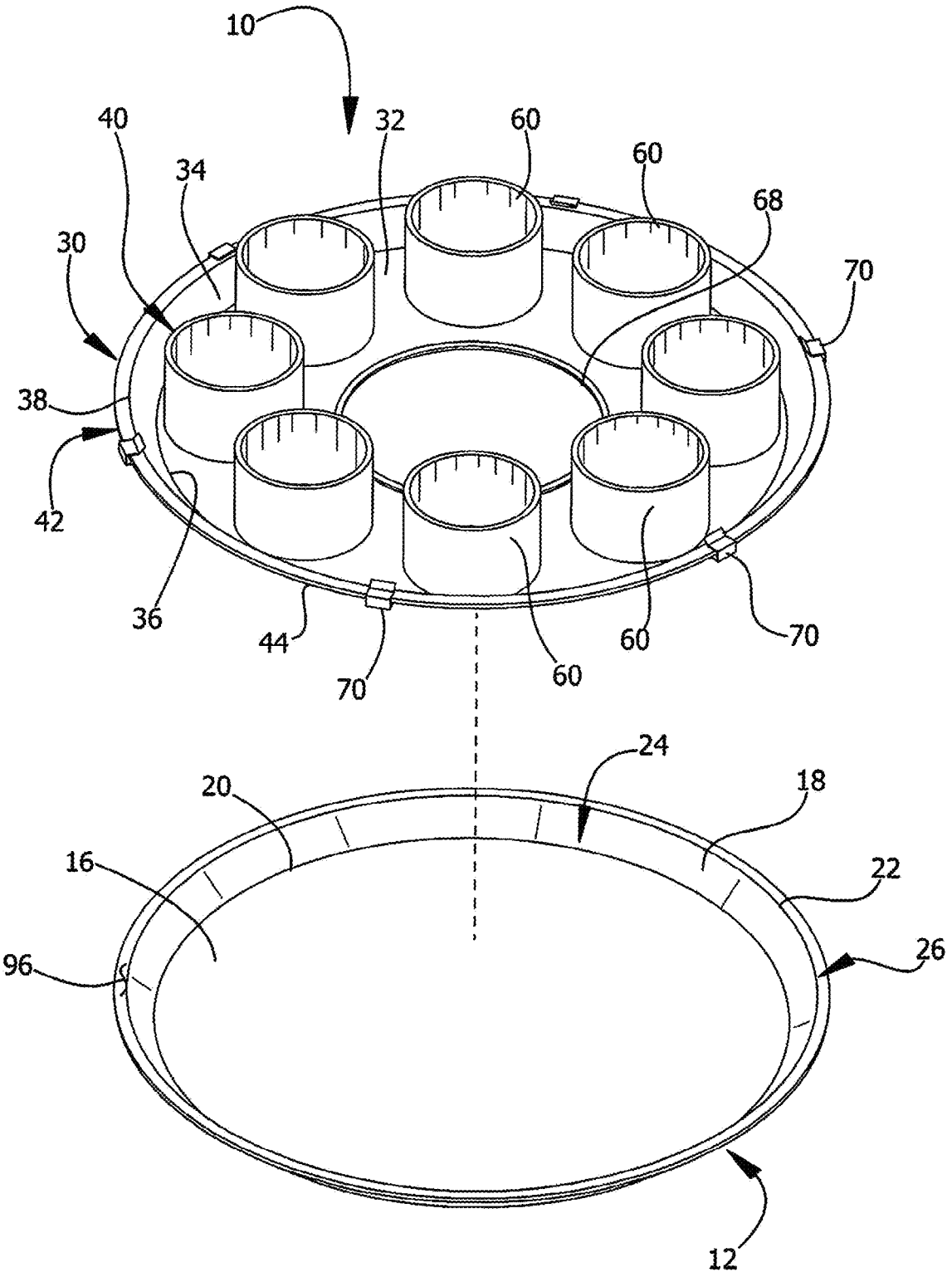
FIG. 3 is an exploded perspective view of a server's tray drink holder assembly according to an embodiment of the disclosure.
Figure 4:
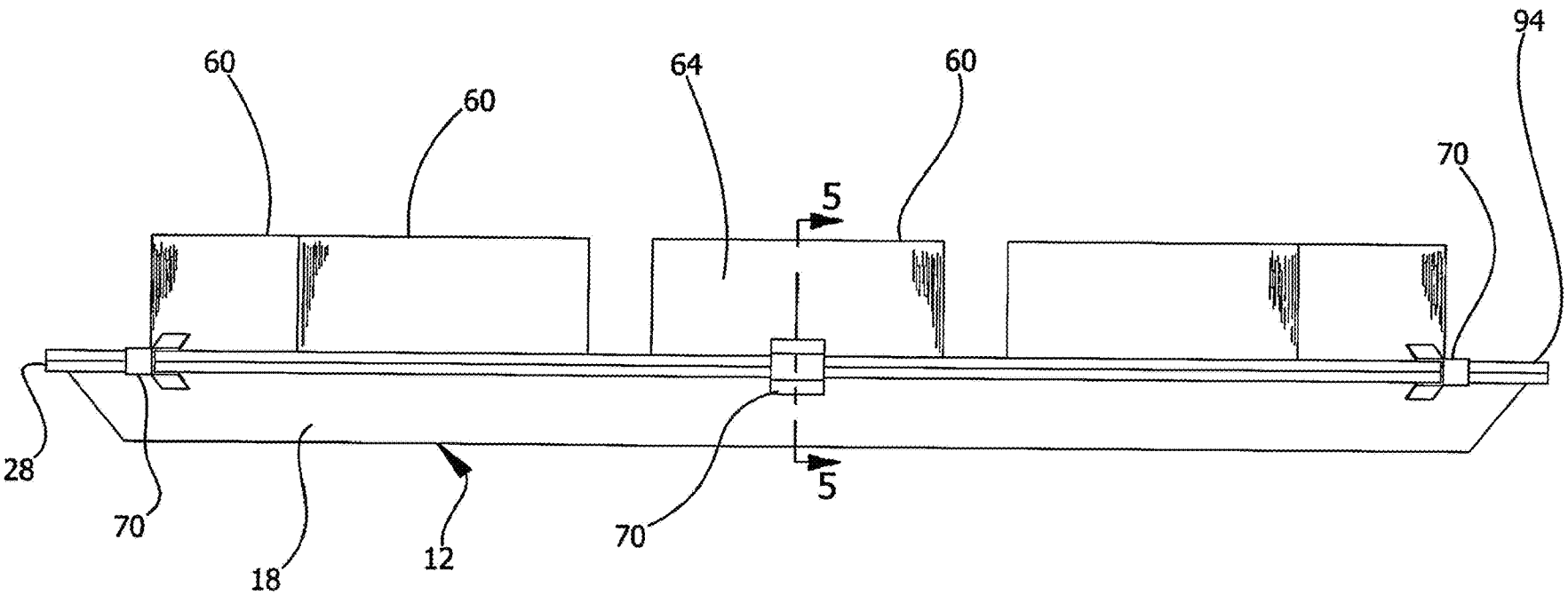
FIG. 4 is a front view of an embodiment of the disclosure.
Figure 5:
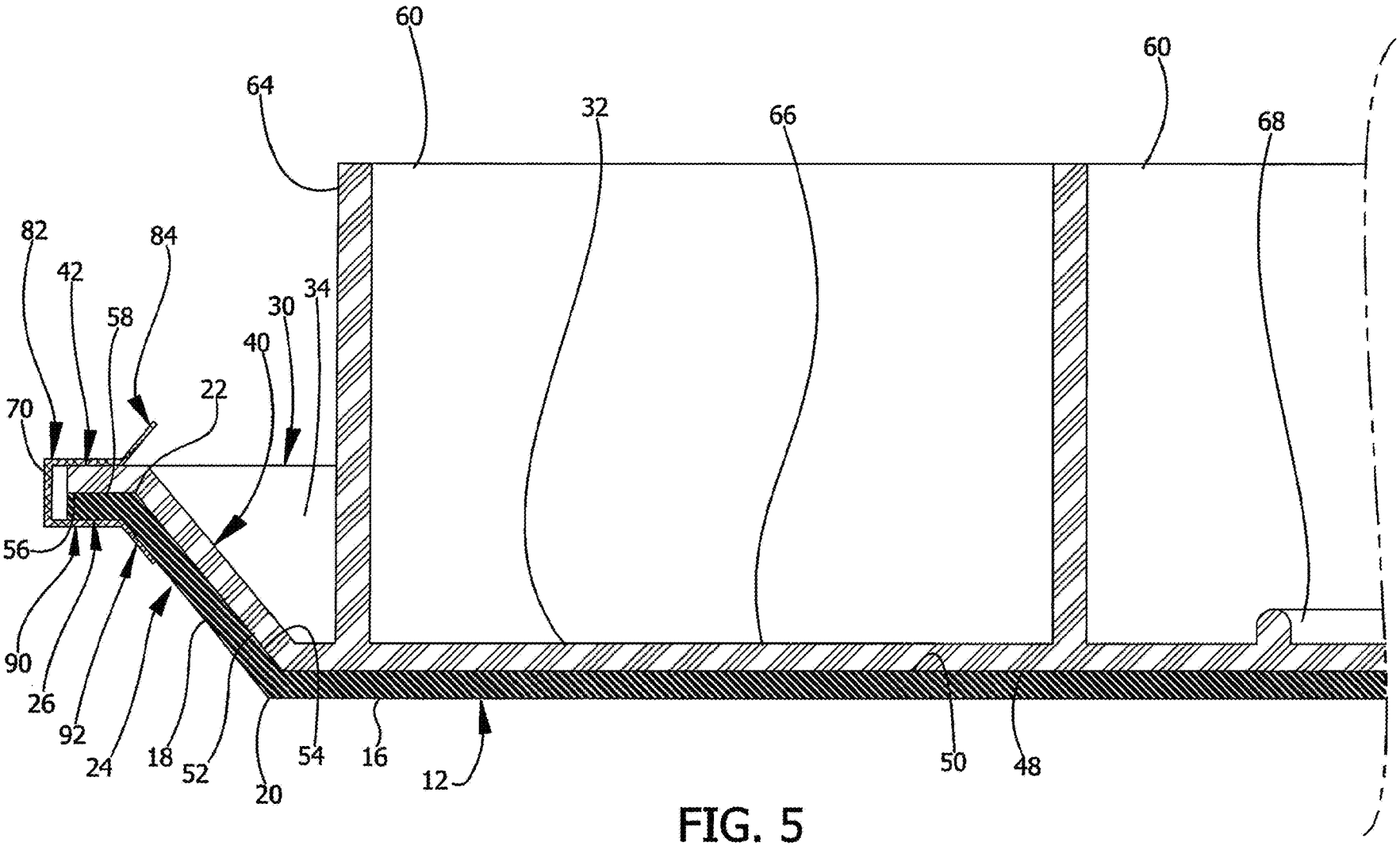
FIG. 5 is a cross sectional view taken along line 5-5 of FIG. 4 of an embodiment of the disclosure.
Figure 6:
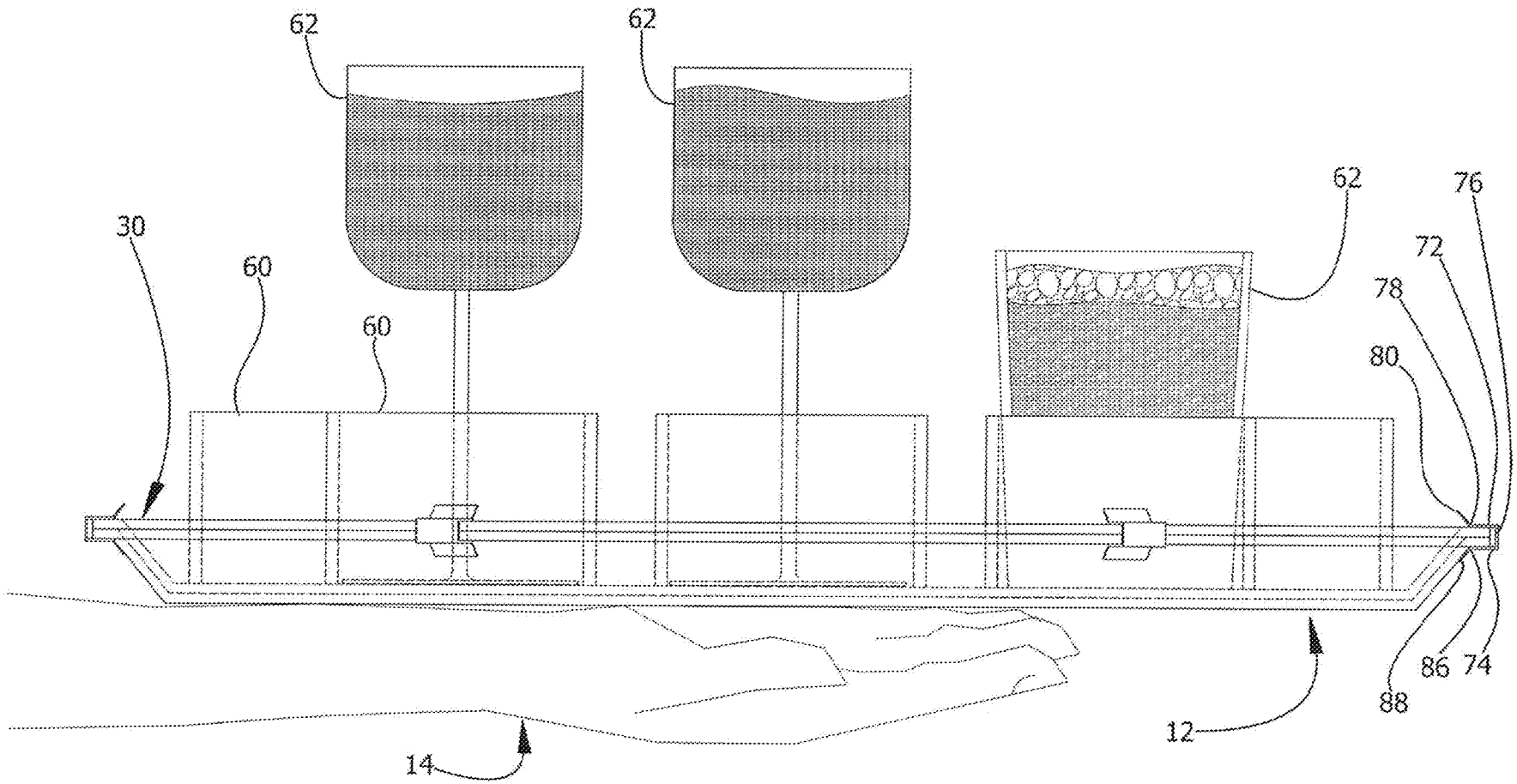
FIG. 6 is a phantom in-use view of an embodiment of the disclosure.

With reference now to the drawings, and in particular to FIGS. 1 through 6 thereof, a new drink holder device embodying the principles and concepts of an embodiment of the disclosure and generally designated by the reference numeral 10 will be described.

As best illustrated in FIGS. 1 through 6, the server's tray drink holder assembly 10 generally comprises a server's tray 12 that has a continuously arcuate outer perimeter such that the server's tray 12 has a circular shape. The server's tray 12 can be carried by a server 14 while the server 14 is transporting food or beverages to patrons of a restaurant. The server's tray 12 has a basal wall 16 and a perimeter wall 18 angling upwardly and outwardly from a perimeter edge 20 of the basal wall 16 and the perimeter edge 20 is continuously arcuate about a center of the basal wall 16. The perimeter wall 18 has a bend 22 defining a lower portion 24 of the perimeter wall 18 which defines an angle with an upper portion 26 of the perimeter wall 18. The lower portion 24 intersects the basal wall 16 and the upper portion 26 lies on a plane that is oriented parallel to the basal wall 16. Additionally, the upper portion 26 has an outer edge 28 and the bend 22 is positioned closer to the outer edge 28 than the basal wall 16.

A carrying plate 30 is provided and the carrying plate 30 is removably positionable on top of the server's tray 12. The carrying plate 30 has a bottom wall 32, an exterior wall 34 angling upwardly and outwardly from a perimeter edge 36 of the bottom wall 32; the perimeter edge 36 of the bottom wall 32 is continuously arcuate about a center of the carrying plate 30 such that the carrying plate 30 has a circular shape. The exterior wall 34 has a bend 38 which defines a primary portion 40 of the exterior wall 34 that forms an angle with a secondary portion 42 of the exterior wall 34. Furthermore, the primary portion 40 intersects the bottom wall 32 and the secondary portion 42 lies on a plane that is oriented parallel to the bottom wall 32.

The secondary portion 42 has an outer edge 44 and the bend 38 in the exterior wall 34 is positioned closer to the outer edge 44 of the secondary portion 42 than the bottom wall 32. The bottom wall 32 has a bottom surface 48 which rests upon an upper surface 50 of the basal wall 16 of the server's tray 12 when the carrying plate 30 is positioned on the server's tray 12. A lower surface 52 of the primary portion 40 rests on an upper surface 54 of the lower portion 24 of the exterior wall 34 of the server's tray 12 when the carrying plate 30 is positioned on the server's tray 12. Additionally, a lower surface 56 of the secondary portion 42 rests on an upper surface 58 of the upper portion 26 of the exterior wall 34 when the carrying plate 30 is positioned on the server's tray 12. The outer edge 44 of the secondary portion 42 is aligned with the outer edge 28 of the upper portion 26 of the exterior wall 34 of the server's tray 12 when the carrying plate 30 is positioned on the server's tray 12.

A plurality of cups 60 is provided and each of the plurality of cups 60 is attached to the carrying plate 30. Each of the plurality of cups 60 can insertably receive a beverage container 62 thereby inhibiting the beverage container 62 from tipping when the server 14 is carrying the server's tray 12. The beverage container 62 may be a wine glass, a rocks tumbler, a can of soda or any other type of beverage container that would commonly be employed in a restaurant or bar. Each of the plurality of cups 60 has an outer wall 64 which extends upwardly from an upper surface 66 of the bottom wall 32 of the carrying plate 30. Additionally, each of the plurality of cups 60 is positioned adjacent to the perimeter edge 36 of the bottom wall 32 of the carrying plate 30. The cups 60 are evenly spaced apart from each other and are distributed around the perimeter edge 36 of the bottom wall 32 of the carrying plate 30.

The carrying plate 30 has a ridge 68 which extends upwardly from the upper surface 66 of the bottom wall 32. The ridge 68 is continuously arcuate about the center of the carrying plate 30 such that the ridge 68 defines a circular shape. Furthermore, the ridge 68 is positioned to surround the center of the carrying plate 30 such that the plurality of cups 60 surrounds the ridge 68. The ridge 68 may have a height ranging between approximately 6.0 mm and 12.0 mm thereby facilitating the ridge 68 to secure a bowl, for example, or other type of vessel on the carrying plate 30.

A plurality of fasteners 70 is provided and each of the plurality of fasteners 70 is attachable to the carrying plate 30 and the server's tray 12 when the carrying plate 30 is positioned on the server's tray 12 for retaining the carrying plate 30 on the server's tray 12. Each of the plurality of fasteners 70 has an upper panel 72, a lower panel 74 and an outer panel 76 extending between and being perpendicularly oriented with the upper panel 72 and the lower panel 74. The upper panel 72 has a bend 78 that is spaced from a distal edge 80 of the upper panel 72 to define a first portion 82 of the upper panel 72 forming an angle with a second portion 84 of the upper panel 72. The lower panel 74 has a bend 86 that is spaced from a distal edge 88 of the lower panel 74 to define a first portion 90 of the lower panel 74 forming an angle of the second portion 92 of the lower panel 74. The first portion 82 of the upper panel 72 intersects the outer panel 76 and the first portion 90 of the lower panel 74 intersects the outer panel 76.

The second portion 84 of the upper panel 72 angles in an opposing direction with respect to the second portion 92 of the lower panel 74. The first portion 82 of the upper panel 72 of each of the plurality of fasteners 70 rests against a top surface 94 of the secondary portion 42 of the exterior wall 34 of the carrying plate 30. Additionally, the first portion 90 of the lower panel 74 of each of the plurality of fasteners 70 rests against a bottom surface 96 of the upper portion 26 of the perimeter wall 18 of the server's tray 12 when the plurality of fasteners 70 are attached to the carrying plate 30 and the server's tray 12. The second portion 92 of the lower panel 74 of each of the plurality of fasteners 70 rests against a bottom surface 98 of the lower portion 24 of the perimeter wall 18 of the server's tray 12 when the plurality of fasteners 70 are attached to the carrying plate 30 and the server's tray 12.

In use, the carrying plate 30 is positioned on the server's tray 12 and each of the fasteners 70 is attached to the carrying plate 30 and the server's tray 12 to retain the carrying plate 30 on the server's tray 12 when the server 14 needs to transport beverages. Each of the beverage containers 62 is positioned in a respective one of the plurality of cups 60 on the carrying tray. In this way the beverage containers 62 are inhibited from tipping over and spilling while the server 14 is carrying the server's tray 12 to deliver the beverage containers 62 to patrons. The plurality of fasteners 70 and the carrying plate 30 are removed from the server's tray 12 when the server 14 needs to carry food plates or other items on the server's tray 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A server's tray drink holder assembly for facilitating beverage containers to be secured to a server's tray while the beverage containers are being transported on the server's tray, said assembly comprising:

a server's tray having a continuously arcuate outer perimeter such that said server's tray has a circular shape wherein said server's tray is configured to be carried by a server while the server is transporting food or beverages to patrons of a restaurant;

a carrying plate being removably positionable on top of said server's tray;

a plurality of cups, each of said plurality of cups being attached to said carrying plate wherein each of said plurality of cups is configured to insertably receive a beverage container thereby inhibiting the beverage container from tipping when the server is carrying said server's tray; and a plurality of fasteners, each of said plurality of fasteners being attachable to said carrying plate and said server's tray when said carrying plate is positioned on said server's tray for retaining said carrying plate on said server's tray, wherein:

each of said plurality of fasteners has an upper panel and a lower panel and an outer panel extending between and being perpendicularly oriented with said upper panel and said lower panel;

said upper panel has a bend that is spaced from a distal edge of said upper panel to define a first portion of said upper panel forming an angle with a second portion of said upper panel;

said lower panel has a bend that is spaced from a distal edge of said lower panel to define a first portion of said lower panel forming an angle of said second portion of said lower panel;

said first portion of said upper panel intersects said outer panel;

said first portion of said lower panel intersects said outer panel; and said second portion of said upper panel angles in an opposing direction with respect to said second portion of said lower panel.

2. The assembly according to claim 1, wherein:

said server's tray has a basal wall and a perimeter wall angling upwardly and outwardly from a perimeter edge of said basal wall;

said perimeter edge is continuously arcuate about a center of said basal wall;

said perimeter wall has a bend defining a lower portion of said perimeter wall which defines an angle with an upper portion of said perimeter wall;

said lower portion intersects said basal wall;

said upper portion lies on a plane being oriented parallel to said basal wall;

said upper portion has an outer edge;

said bend is positioned closer to said outer edge than said basal wall;

said carrying plate has a bottom wall and an exterior wall angling upwardly and outwardly from a perimeter edge of said bottom wall;

said perimeter edge of said bottom wall is continuously arcuate about a center of said carrying plate such that said carrying plate has a circular shape;

said exterior wall has a bend defining a primary portion of said exterior wall forming an angle with a secondary portion of said exterior wall;

said primary portion intersects said bottom wall;

said secondary portion lies on a plane being oriented parallel to said bottom wall;

said secondary portion has an outer edge;

said bend in said exterior wall is positioned closer to said outer edge of said secondary portion than said bottom wall;

said bottom wall has a bottom surface which rests upon an upper surface of said basal wall of said server's tray when said carrying plate is positioned on said server's tray;

a lower surface of said primary portion rests on an upper surface of said lower portion of said exterior wall of said server's tray when said carrying plate is positioned on said server's tray;

a lower surface of said secondary portion rests on an upper surface of said upper portion of said exterior wall when said carrying plate is positioned on said server's tray; and said outer edge of said secondary portion is aligned with said outer edge of said upper portion of said exterior wall of said server's tray when said carrying plate is positioned on said server's tray.

3. The assembly according to claim 2, wherein:

each of said plurality of cups has an outer wall extending upwardly from an upper surface of said bottom wall of said carrying plate;

each of said plurality of cups is positioned adjacent to said perimeter edge of said bottom wall of said carrying plate; and said plurality of cups is evenly spaced apart from each other and is distributed around said perimeter edge of said bottom wall of said carrying plate.

4. The assembly according to claim 2, wherein:

said carrying plate has a ridge extending upwardly from said upper surface of said bottom wall;

said ridge is continuously arcuate about said center of said carrying plate such that said ridge defines a circular shape; and said ridge is positioned to surround said center of said carrying plate such that said plurality of cups surrounds said ridge.

5. A server's tray drink holder assembly for facilitating beverage containers to be secured to a server's tray while the beverage containers are being transported on the server's tray, said assembly comprising:

a server's tray having a continuously arcuate outer perimeter such that said server's tray has a circular shape wherein said server's tray is configured to be carried by a server while the server is transporting food or beverages to patrons of a restaurant, said server's tray having a basal wall and a perimeter wall angling upwardly and outwardly from a perimeter edge of said basal wall, said perimeter edge being continuously arcuate about a center of said basal wall, said perimeter wall having a bend defining a lower portion of said perimeter wall which defines an angle with an upper portion of said perimeter wall, said lower portion intersecting said basal wall, said upper portion lying on a plane being oriented parallel to said basal wall, said upper portion having an outer edge, said bend being positioned closer to said outer edge than said basal wall;

a carrying plate being removably positionable on top of said server's tray, said carrying plate having a bottom wall and an exterior wall angling upwardly and outwardly from a perimeter edge of said bottom wall, said perimeter edge of said bottom wall being continuously arcuate about a center of said carrying plate such that said carrying plate has a circular shape, said exterior wall having a bend defining a primary portion of said exterior wall forming an angle with a secondary portion of said exterior wall, said primary portion intersecting said bottom wall, said secondary portion lying on a plane being oriented parallel to said bottom wall, said secondary portion having an outer edge, said bend in said exterior wall being positioned closer to said outer edge of said secondary portion than said bottom wall, said bottom wall having a bottom surface which rests upon an upper surface of said basal wall of said server's tray when said carrying plate is positioned on said server's tray, a lower surface of said primary portion resting on an upper surface of said lower portion of said exterior wall of said server's tray when said carrying plate is positioned on said server's tray, a lower surface of said secondary portion resting on an upper surface of said upper portion of said exterior wall when said carrying plate is positioned on said server's tray, said outer edge of said secondary portion being aligned with said outer edge of said upper portion of said exterior wall of said server's tray when said carrying plate is positioned on said server's tray;

a plurality of cups, each of said plurality of cups being attached to said carrying plate wherein each of said plurality of cups is configured to insertably receive a beverage container thereby inhibiting the beverage container from tipping when the server is carrying said server's tray, each of said plurality of cups having an outer wall extending upwardly from an upper surface of said bottom wall of said carrying plate, each of said plurality of cups being positioned adjacent to said perimeter edge of said bottom wall of said carrying plate, said plurality of cups being evenly spaced apart from each other and being distributed around said perimeter edge of said bottom wall of said carrying plate, said carrying plate having a ridge extending upwardly from said upper surface of said bottom wall, said ridge being continuously arcuate about said center of said carrying plate such that said ridge defines a circular shape, said ridge being positioned to surround said center of said carrying plate such that said plurality of cups surrounds said ridge; and a plurality of fasteners, each of said plurality of fasteners being attachable to said carrying plate and said server's tray when said carrying plate is positioned on said server's tray for retaining said carrying plate on said server's tray, each of said plurality of fasteners having an upper panel and a lower panel and an outer panel extending between and being perpendicularly oriented with said upper panel and said lower panel, said upper panel having a bend being spaced from a distal edge of said upper panel to define a first portion of said upper panel forming an angle with a second portion of said upper panel, said lower panel having a bend being spaced from a distal edge of said lower panel to define a first portion of said lower panel forming an angle of said second portion of said lower panel, said first portion of said upper panel intersecting said outer panel, said first portion of said lower panel intersecting said outer panel, said second portion of said upper panel angling in an opposing direction with respect to said second portion of said lower panel, said first portion of said upper panel of each of said plurality of fasteners resting against a top surface of said secondary portion of said exterior wall of said carrying plate and said first portion of said lower panel of each of said plurality of fasteners resting against a bottom surface of said upper portion of said perimeter wall of said server's tray when said plurality of fasteners are attached to said carrying plate and said server's tray, said second portion of said lower panel of each of said plurality of fasteners resting against a bottom surface of said lower portion of said perimeter wall of said server's tray when said plurality of fasteners are attached to said carrying plate and said server's tray.

* * * * *